United States Patent [19]

Morton et al.

[11] 4,195,864

[45] Apr. 1, 1980

[54] MULTI-PRODUCT COUPON

[75] Inventors: Robert S. Morton; James R. Amrein, both of Westport, Conn.

[73] Assignee: Promotional Marketing Corporation, Westport, Conn.

[21] Appl. No.: 949,946

[22] Filed: Oct. 10, 1978

[51] Int. Cl.[2] ..... B42D 15/00

[52] U.S. Cl. ..... 283/56

[58] Field of Search ..... 283/56, 22

[56] References Cited

U.S. PATENT DOCUMENTS

| | | | |
|---|---|---|---|
| 786,018 | 3/1905 | Farnsworth et al. | 283/56 |
| 3,520,560 | 7/1940 | Isaac | 283/56 |
| 3,582,111 | 6/1971 | Siiter | 283/56 |

OTHER PUBLICATIONS

Publisher's Clearing House Literature.

*Primary Examiner*—John McQuade

*Attorney, Agent, or Firm*—Mattern, Ware, Davis & Stoltz

[57] ABSTRACT

A printed promotional coupon comprises a multiple-product base coupon and a plurality of product stamps. The product stamps bear indicia defining a coupon redemption value for a particular product purchase. The coupon acquires value and becomes effective only by the affixing of one or more stamps onto the base coupon, each at a location which bears indicia corresponding to the associated stamp. The coupon holder can determine the overall redemption value of the coupon by selecting the number of stamps affixed, corresponding to the number of different products purchased at any retail store carrying the products. In one embodiment, the base coupon and product stamp form a single sheet, with the product stamps being detachable from the base coupon. In another embodiment, the product stamps are on a card or sheet separate from but distributed with the base coupon.

8 Claims, 2 Drawing Figures

FIG. 1
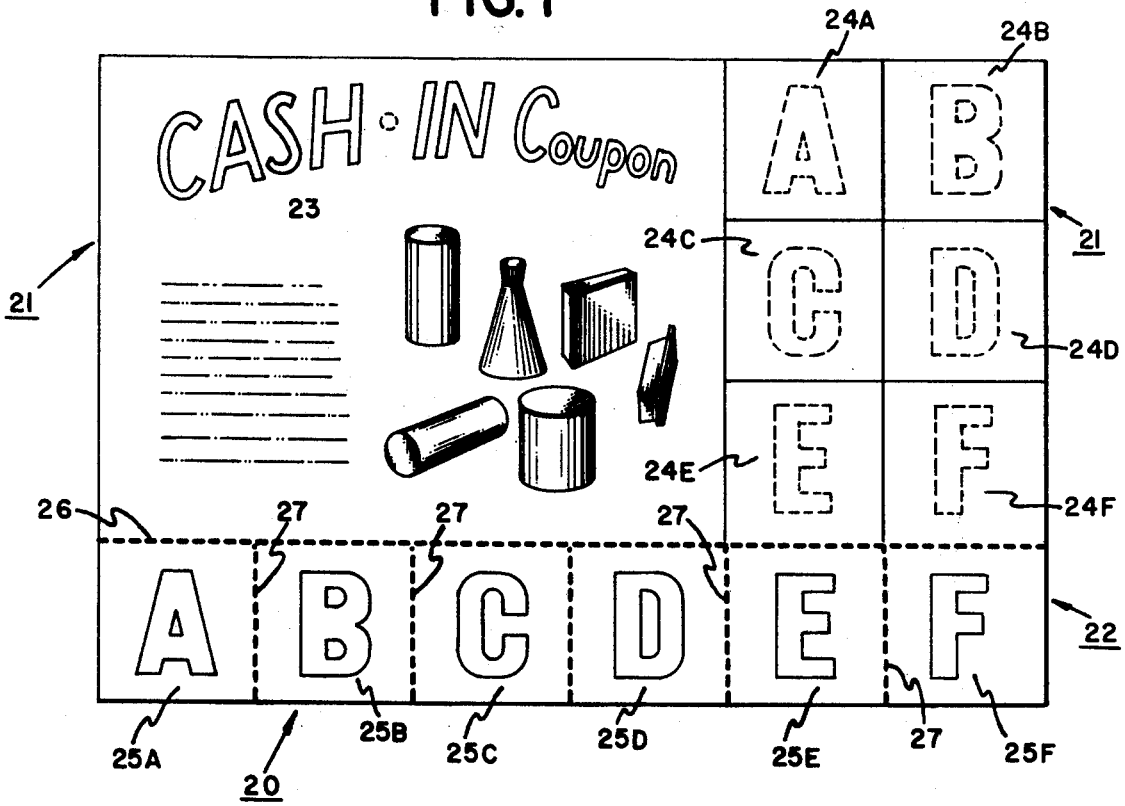
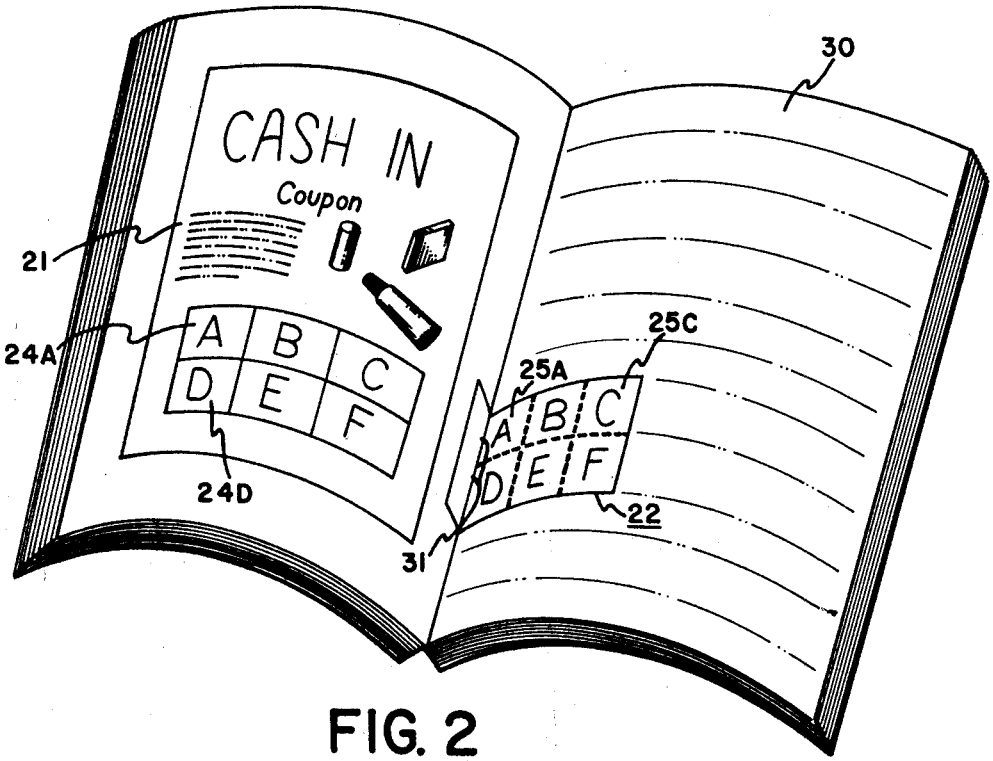
FIG. 2

MULTI-PRODUCT COUPON

BACKGROUND ART

This invention relates to promotion and marketing techniques and more particularly to marketing techniques which involve distribution of product discount coupons redeemed for consumer products at retail stores.

The use of coupons by product manufacturers is well known for promoting sales in retail store outlets, offering customers changes to save money or get discounts on particular products or services. "Coupon clipping" has long been a popular practice among consumers, and the use of coupons as a successful sales and marketing tool has been well proven. Conventional coupons, however, specify savings for a single product (which often requires a shopper to sort through a bagful or drawerful of discount coupons in order to find those desired) and they involve payment of a handling charge of approximately five cents for each coupon, to be paid by the coupon sponsor to the retailer redeeming the coupon.

The present invention involves a multi-product coupon, which both decreases the number of coupons which the shopper must store and carry, and eliminates the multiplicity of costly handling charges.

The closest prior art known in U.S. Pat. No. 3,582,111 issued on June 1, 1971 to Donald H. Siiter. The Siiter patent discloses a marketing technique whereby a plurality of stamps are distributed to customers through periodicals such as magazines or newspapers. The stamps are intended to be affixed to specified value base coupons which are printed on one of the regular pages of the same periodical, and by affixing particular stamps to these base coupons, the cash saving or discount value is thereby increased beyond the original specified value of the base coupon. The stamps are designed to represent potential savings on coupons distributed over a period of time, i.e., some stamps would be used during the current week, other stamps the next week and still other stamps the week after. Since the base coupons would be distributed during the different week, the customer was required to save the stamps (which were distributed only during the first week), and was also required to purchase later editions of the periodical to be certain that he received all of the base coupons. This marketing technique is intended to require customers to purchase the periodicals, to get the base coupon in order to use the stamps, as well as to provide cash savings to the customers on the products identified by the coupon and stamps. The coupon of the present invention does not make additional purchases a prerequisite to redemption of the coupon.

The invention disclosed in Siiter also uses only traditional single product coupons, whereas the present invention uses a unique multi-product coupon. The base coupons in Siiter also have a specified redemption value without the stamp, whereas the present invention embodies a base coupon having no redemption value without one or more affixed stamps.

Magazine subscription offers, such as those made by Publisher's Clearing House, use the concept of a base card or sheet to which the subscriber affixes stamps corresponding to the magazine subscriptions purchased. The affixing of these stamps, however, does not create a coupon having any retail product redemption value. It is only a convenient, clever way of identifying a choice of magazine subscriptions. The same result could be achieved by writing the desired magazine choices on an order blank. The present invention, on the other hand, comprises a multiple product coupon which is formed by the consumer himself and is redeemable at any retain store carrying the designated products. Additionally, no mail-order redemption is provided by the present invention.

Therefore, it is a principal object of the present invention to provide a redeemable multiple-product coupon having no inherent value, whose redemption value in retail stores is determined by the nature and number of product-designating stamps selected and affixed by the consumer to the multiple product coupon.

It is another object of the present invention to provide a single opportunity for retail redemption of the redeemable coupon, thereby creating incentive to purchase additional retail items.

It is yet another object to provide conveniently available stamps affixable to the coupon for selecting the retail items eligible for discount upon redemption of the coupon.

It is still another object to reduce the handling expense charges by providing a multi-product single-coupon format, thereby permitting additional savings to be passed on to the coupon holder.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

DISCLOSURE OF INVENTION

The present invention discloses a base coupon printed with a number of different consumer product locations. Each of the product locations may designate a particular different product offered by the coupon sponsor. A plurality of gummed or adhesive backed stamps are provided along with the base coupon, and may be a part of the base coupon sheet as a detachable portion, or as a separate card. The stamps are printed to correspond to the products identified by the different product locations on the base coupon. Each stamp also bears a cash saving value or other such retain product discount. The customer selects which products he intends to purchase, and then affixes the corresponding stamps to the designated locations on the base coupon. The retail redemption value of the coupon is determined by the sum of the individual cash discount values determined by each of the stamps that is affixed to the base coupon. The base coupon by itself has no redemption value. The redemption value of the coupon is thus determined by the customer, depending on the number of products he or she wishes to purchase.

BRIEF DESCRIPTION OF THE DRAWINGS

For a fuller understanding of the nature and objects of the invention, reference should be had to the following detailed description taken in connection with the accompanying drawing, in which:

FIG. 1 is a diagrammatic view of a representative multi-product coupon having a variable, customer determined redemption value.

FIG. 2 is a perspective view of a periodical showing a multi-product coupon similar to that in FIG. 1.

BEST MODE FOR CARRYING OUT THE INVENTION

Referring to FIGS. 1 and 2, there is shown a multi-product variable value coupon comprising a base coupon sheet 21 and a plurality of product stamps 22. The base coupon sheet 21 further comprises a coupon information area 23 and product designating locations 24A through 24F. The product stamps 22 further comprise individual product designating stamps 25A through 25F.

Each of the product designating stamps 25A through 25F may preferably correspond to a particular product designating location 24A through 24F; i.e., product stamp 25A corresponds to product designating location 24A, product stamp 25B corresponds to location 24B and so on, or the product locations 24A–24F may be designated generally, such as by numbers or letters.

In FIG. 1, the plurality of product stamps 22 is integral with the base coupon sheet 21, and detachable therefrom along perforation 26 therebetween. Adjoining product designating stamps 25A through 25F are also detachable from one another along perforations 27 therebetween. The product designating stamps 25A through 25F are gummed on the back in order to be easily affixed to the product designating locations 24A through 24F, and it is evident that other forms of adhesive may be used or the adhesive may be applied to locations 24 rather than the backs of stamps 25 without changing the operation of the present invention.

In FIG. 2, the base coupon 21 is shown separate from the gummed or adhesive backed product stamps 22. This would occur in a situation such as when the base coupon was printed as a part of a newspaper page, with the product stamps being a part of a separate pop-up card or free-standing insert. FIG. 2 shows the product stamps 22 bound into a periodical 30 by staple 31. It is clear that as long as the base coupon and the product stamps are distributed at the same time, no physical attachment is necessary in their distribution.

The single-sheet configuration of FIG. 1 has the advantage of minimizing or avoiding inadvertent separation of stamps from coupon, and inadvertent losses of one or the other by the retail consumer before product selection and coupon redemption have been completed.

The use of the multi-product coupon in marketing campaigns will now be described. The customer can receive his multi-product coupon in a number of ways-,—among them direct mail distribution or distribution in periodicals. It is contemplated that most customers will receive their multi-product coupons through periodicals such as magazines or newspapers. By themselves, the base coupon and the product designating stamps possess no retail redemption value until the stamps are affixed to the coupon. The coupon acquires retain redemption value only when one or more particular product-designating stamps are affixed to locations on the base coupon. The value of the coupon is then determined by the cash redemption value printed on each stamp. In this way, customers can choose which products they wish to purchase by the selection offered by the stamps. They are under no obligation, but rather can purchase as many or as few products as they wish. It is evident, however, that the redemption value of the coupon increases with the number of products purchased. It is intended that the multi-product coupon be redeemable at any retail store that carries the associated products.

By providing only one base coupon and hence only one opportunity for coupon redemption, the retail product manufacturer or coupon sponsor increases the incentive for the customer to purchase additional products. Given only one opportunity, the customer would be expected to seize this opportunity to purchase immediate need items as well as anticipated future need items. In this way, the coupon sponsor or manufacturer can print stamps corresponding to a wide range of products. The "one-shot" coupon then will cause many customers to purchase a selection of products in order to save money under the assumption that the product would be purchased sooner or later anyway. Newly introduced products can also be marketed in this way successfully, as the multiple-product coupon gives the consumer an added impetus to try new or different products.

An important advantage of the single multi-product coupon is in the reduction of handling charges. In all cases the retail store or individual redeeming a coupon receives a handling charge of approximately five cents for each coupon redeemed from the coupon sponsor or manufacturer, in addition to the coupon redemption value. The present invention, however, by providing only one coupon for a number of products, eliminates the multiple handling charges that would need to be paid if each of the products represented an individual coupon. These savings can be passed on to the consumer as increased coupon redemption values. By eliminating individual coupons for a number of products, the manufacturer can save money in coupon printing and distribution costs.

Each FIGURE shows a multi-product coupon offering a total of six products. This is not intended to be any limitation but is shown merely as an example. Any number of products may be offered as determined by the coupon sponsor or manufacturer. It is also possible that the number of product stamps offered may be greater than the number of locations on the base coupon. In this case, the product locations would be designated generally, such as by the notation "Product 1" or "Selection 1". In the situation where the number of products available equaled the number of product locations, the locations can be specifically identified by product name. The customer can then affix the desired stamps to the corresponding locations on the base coupon.

By providing only one coupon for the customer to redeem, it is much easier for the manufacturer to predict a coupon rate of redemption in order to assure that sufficient products are distributed to allow for increased sales based on coupon redemption. It is much more difficult to predict coupon redemption rates when a large number of individual coupons are involved as customers may save certain coupons for a period of time before redeeming them.

It will thus be seen that the objects set forth above, among those made apparent from the preceding description, are efficiently attained and, since certain changes may be made in the above article without departing from the scope of the invention, it is indended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A multiple retail product coupon freely redeemable at different retail stores and having a variable retail product purchase discount value selectively determined by the retail consumer comprising:

(A) a unitary base portion with no indicated value having a plurality of indicia-defined locations each designating a different type or number of retail consumer products; and (B) a plurality of discount stamps, each bearing indicia defining one said different type or number of retail consumer products and a product discount redemption value, each fixedly mountable to the base portion at a designated indicia-defined location, the combination of the base portion and the fixedly mounted discount stamps creating a unitary retail store-redeemable multi-discount coupon having one of a plurality of retail redemption values determined solely by the consumer's selection from among the fixedly mounted discount stamps.

2. The coupon defined in claim 1, wherein a redemption value is created only upon the mounting of the stamps to the unitary base portion.

3. The coupon defined in claim 2, wherein the stamps incorporate a backing comprising an adhesive material.

4. The coupon defined in claim 3, wherein the plurality of stamps and the base portion form a unitary sheet, with the stamps disposed at the periphery thereof and detachable from the base portion for fixable mounting to the designated indicia-defined locations of the base portion.

5. The coupon defined in claim 3, wherein the plurality of stamps form a sheet separate from the base portion, the stamps being individually separable for fixable mounting to the designated indicia-defined locations of the base portion.

6. A method for manufacturing and using a multiple product discount coupon freely redeemable at retail stores and having a retail redemption value, determined by the retail consumer, comprising the steps of:

(A) printing a unitary discount coupon base portion with no indicated value bearing a plurality of indicia-defined locations each designating a different number or type of retail consumer product;

(B) printing a plurality of indicia-bearing retail product discount stamps each identifying one said different number or type of retail consumer product, (C) providing means for fixedly mounting one or more of the plurality of stamps upon the base portion at the respective designated indicia-defined locations to form a discount coupon having a retail redemption value determined solely by the affixed stamps;

(D) distributing the unitary base portion and the indicia-bearing stamps together in a high-circulation volume distribution step, and (E) redeeming the discount coupon through retail outlets for the designated number or type of retail merchandise items of higher value at the discount redemption value indicated by the affixed stamps.

7. The method for manufacturing and using a multiple product discount coupon defined in claim 6, wherein the unitary base portion and the plurality of stamps are printed as a unitary sheet with the stamps disposed at the periphery thereof and detachable from the base portion for fixable mounting to the designated indicia-defined locations of the base portion.

8. The method for manufacturing and using a multiple product discount coupon defined in claim 6, wherein the plurality of stamps is printed as a sheet separate from the unitary base portion, the stamps being individually separable for fixable mounting to the designated indicia-defined locations of the base portion.

* * * * *

UNITED STATES PATENT AND TRADEMARK OFFICE

CERTIFICATE OF CORRECTION

PATENT NO. : 4,195,864

DATED : April 1, 1980

INVENTOR(S) : Robert S. Morton and James R. Amrein

It is certified that error appears in the above-identified patent and that said Letters Patent are hereby corrected as shown below:

Column 1, Line 12 - "changes" should be --chances--;

Column 1, Line 27 - "in" should be --is--;

Column 1, Line 43 - "week" should be --weeks--;

Column 2, Line 4 - "retain" should be --retail--;

Column 2, Line 46 - "retain" should be --retail--;

Column 3, Line 55 - "retain" should be --retail--;

Column 4, Line 59 - "indended" should be --intended--.

Signed and Sealed this

*Twenty-eighth* Day of *October 1980*

[SEAL]

*Attest:*

SIDNEY A. DIAMOND

*Attesting Officer*

*Commissioner of Patents and Trademarks*